US008451212B2

(12) United States Patent
Tanaka et al.

(10) Patent No.: US 8,451,212 B2
(45) Date of Patent: May 28, 2013

(54) DISPLAY APPARATUS AND CONTROL CIRCUIT OF THE SAME

(75) Inventors: Kazuhiko Tanaka, Fujisawa (JP); Yasutaka Tsuru, Yokohama (JP); Yuya Ogi, Yokohama (JP)

(73) Assignee: Hitachi Consumer Electronics Co., Ltd., Tokyo (JP)

( * ) Notice: Subject to any disclaimer, the term of this patent is extended or adjusted under 35 U.S.C. 154(b) by 253 days.

(21) Appl. No.: 12/963,342

(22) Filed: Dec. 8, 2010

(65) Prior Publication Data

US 2011/0157247 A1 Jun. 30, 2011

(30) Foreign Application Priority Data

Dec. 25, 2009 (JP) ..... 2009-294509

(51) Int. Cl.
*G09G 3/3406* (2006.01)

(52) U.S. Cl.
USPC ..... 345/102; 345/690

(58) Field of Classification Search
USPC ..... 345/87–103, 690–693, 207; 362/600, 362/561
See application file for complete search history.

(56) References Cited

U.S. PATENT DOCUMENTS

| | | | | |
|---|---|---|---|---|
| 7,113,163 | B2 * | 9/2006 | Nitta et al. | 345/102 |
| 2008/0129680 | A1 | 6/2008 | Kimura et al. | |
| 2008/0284354 | A1 | 11/2008 | Chen et al. | |
| 2009/0097775 | A1 * | 4/2009 | Monobe et al. | 382/268 |
| 2010/0225574 | A1 * | 9/2010 | Fujiwara et al. | 345/102 |

FOREIGN PATENT DOCUMENTS

| | | | |
|---|---|---|---|
| EP | 2 237 258 | A1 | 10/2010 |
| JP | 4285532 | B2 | 4/2009 |
| WO | WO 2009/096068 | A1 | 8/2009 |

OTHER PUBLICATIONS

Partial European Search Report dated Jul. 5, 2011 (eight (8) pages).

* cited by examiner

*Primary Examiner* — Liliana Cerullo
(74) *Attorney, Agent, or Firm* — Crowell & Moring LLP

(57) ABSTRACT

An image display device using the area control method for eliminating irregularities as seen from the side and also capable of lowering power consumption. The degree of flatness indicating the image flatness of an image in each image area is calculated, and in areas that are flat the light source luminance is set high in order to lessen irregularities as seen from the side; and in areas that are not flat the irregularities are difficult to perceive as seen from the side so an effect that cuts power consumption is obtained without having to correct the light source luminance.

16 Claims, 13 Drawing Sheets

DISPLAY APPARATUS AND CONTROL CIRCUIT OF THE SAME

CLAIM OF PRIORITY

The present application claims priority from Japanese patent application JP 2009-294509 filed on Dec. 25, 2009, the content of which is hereby incorporated by reference into this application.

FIELD OF THE INVENTION

The present invention relates to an image display device for displaying image data that was input and relates in particular to an image display device capable of lowering power consumption.

BACKGROUND OF THE INVENTION

In display devices such as LCD that utilize backlighting without emitting their own light, the backlighting usually consumes most of the electrical power. In such cases, lowering the power consumed by backlighting is the key to lowering the total power consumption in the display device.

Attempts were therefore made to lower power consumption in the display device by lowering the light intensity of the backlight in dark image scenes. Simply lowering the light intensity of the backlight to 1/N also lowers the screen brightness to 1/N. However, if the transmittance of each liquid crystal pixel could be increased N times by correcting each pixel value, while also lowering the light intensity of the backlight to 1/N, then a final screen brightness can be maintained.

The transmittance of each liquid crystal pixel cannot however be a larger value than the maximum possible transmittance of the liquid crystal element. The N value therefore has an upper limit. Setting N to a maximum within a range that will not deteriorate the image quality requires adjusting the N value so that the liquid crystal pixel transmittance of the brightest pixel in the display image is the maximum pixel transmittance. This method for collectively controlling the backlight luminance value on the entire screen is called global dimming.

However if there is a luminescent spot on even just one point on the screen during global dimming, then the entire backlight luminance rises because the N value cannot be increased by this luminescent spot. This rise in backlight luminance sometimes suppresses the power saving effect due to the particular image content.

Due to this problem, in recent years much attention is focusing on methods called area control or local dimming that control the backlit luminance in each area by dividing the screen up into small areas and utilizing a light source matching each separate area to autonomously control the light emission intensity in each light source. In this method, the light emission intensity of the corresponding light source in each area is set based on the pixel values in that area using the same method as in global dimming. Applying this method to all areas within the screen sets the light emission intensity all the light sources. Along with using these values to control all light sources, each pixel value for the input image can be corrected the same as for global dimming to allow lowering the electrical power consumption with almost no loss in image quality.

The display luminance can in this way be maintained by correcting each pixel value along with reducing the backlighting by area control to boost the transmittance of the liquid crystal element. The relation between liquid crystal transmittance and each pixel is generally a power characteristic called the gamma characteristic dependent on the liquid crystal panel. The area control in other words, corrects the liquid crystal element transmittance according to the backlight fading rate and sets the final pixel value from this transmittance and the liquid crystal panel gamma characteristic. So the panel gamma characteristic is preferably unchangeable during area control.

Fluctuations in the gamma characteristic however are unavoidable according to the viewing direction relative to the actual liquid crystal panel. In this case, correcting the image based on the gamma characteristics when looking at the screen from the front may cause a strange impression if the screen is viewed from the side.

A method to alleviate this problem by limiting the amount of spatial change in backlight luminance was proposed in Japanese Patent No. 4235532. However, this method reduces the backlight fading rate which suppresses the effect that lowers power consumption.

In many cases this method provides images with almost no strange impression when viewed from the side after applying area control. Even in these images however, the processing reduces the backlight fading rate, which in turn suppresses the effect that cuts power consumption.

SUMMARY OF THE INVENTION

Screen brightness in the liquid crystal display device is calculated as the product of the backlight brightness for each coordinate, and the transmittance rate of the liquid crystal element at the corresponding position. Area control lowers the power consumption by decreasing the luminance of each light source making up the backlight according to the image. Lowering the light source luminance also decreases the backlight luminance at each coordinate but the same luminance can be maintained by raising the transmittance of the liquid crystal element at corresponding positions. The transmittance between the input pixel value and liquid crystal element in a typical liquid crystal panel are related as shown in the following formula.

$$\text{Transmittance}=\text{gamma}(\text{pixel value}) \quad \text{(Formula 1)}$$

Here, y=gamma (x) is a function called the gamma function, and has characteristics approaching that of the power function. Taking advantage of this characteristic, the brightness of a certain coordinate before applying area control can be calculated by the following formula. Here the BL luminance is the backlight luminance.

$$\text{Screen brightness}=\text{gamma}(\text{pixel value})\times BL\ \text{luminance} \quad \text{(Formula 2)}$$

Expressing the screen brightness, pixel value, and BL luminance after applying area control by attaching an apostrophe' allows expressing the screen brightness after applying area control by the following formula.

$$\text{Screen brightness}'=\text{gamma}(\text{pixel value}')\times BL\ \text{luminance}' \quad \text{(Formula 3)}$$

Exerting control so that the area control causes no change in screen brightness requires making the right sides of Formula 2 and Formula 3 equivalent. Changing the formula so that the right side of Formula 2 equals the right side of Formula 3 yields the following formula.

$$\text{Gamma}(\text{pixel value}')=BL\ \text{luminance}/BL\ \text{luminance}'\times \text{gamma}(\text{pixel value}) \quad \text{(Formula 4)}$$

To simplify the formula even further, along with making use of power characteristics of y=gamma(x), placing its inverse function so that x=igamma(y), allows simplifying (Formula 4) as shown in the next formula.

Pixel value' 1/igamma(*BL* luminance'/*BL* luminance)×pixel value (Formula 5)

The pixel value after area control can in this way be calculated from the pixel value before area control, the panel gamma characteristic, and the backlight luminance ratio before and after area control.

However, the visual angle in the actual liquid crystal display panel varies with the gamma characteristic. The igamma (BL luminance'/BL luminance) value in Formula 5 changes when the screen is viewed from the front and when the screen is viewed from the side. So when the pixel value is corrected as a precondition to prevent the luminance before and after area control from changing when the screen is viewed (and heard) from the front, then the luminance before and after area control will not match when the screen is seen from the side. The size of the displacement changes according to the x value of igamma (x) or namely, due to the backlight luminance fading rate. When the backlight luminance fading rate varies with the position in the screen, the size of the displacement differs due to the position within the screen so that an image that looks correct from the front of the screen has irregularities when viewed from the side.

A feature of these irregularities is that they are obvious when on a flat area of the image but are difficult to find in complex areas of the image. Moreover the visual angle dependency on igamma (x) becomes smaller as the x value approaches 1. In other words, as the backlight luminance ratio before and after area control equaling BL luminance'/BL luminance, approaches 1, the visual angle dependency becomes smaller. However, a backlight luminance ratio approaching 1 signifies that the backlight fading factor is approaching 1 which suppresses the effect that lowers power consumption.

In view of these problems with the related art, the present invention has the object of providing an image display device capable of greatly lowering electrical power consumption while eliminating irregularities in the screen as seen from the side by utilizing these image characteristics.

In order to achieve the above objects, the image display device of this invention contains an image display unit with a structure including a plurality of transmittance control elements mounted on a two-dimensional plane and capable of changing the light transmittance according to the pixel value of the input image, a light source unit containing a plurality of light sources capable of independently controlling the light emission intensity in each area of a screen divided into a plurality of areas and installed so that the light emitted by the plurality of light sources becomes transmitted light for the image display unit, a light source luminance decision unit for setting the light emission luminance value of each of the light sources making up the light source unit according to the input image, a light source luminance control unit to control the luminance of light emitted from each light source making up the light source unit according to the light emission luminance value of each light source set by the light source luminance decision unit, and an image correction unit to correct the pixel values of the image input to the image display unit according to the light emission luminance value of each light source set by the light source luminance decision unit; and a feature of the image display device is that: when setting the light emission luminance value, the light source luminance decision unit divides the input image into a plurality of areas corresponding to the plurality of light sources, and calculates the flatness as an indicator expressing the flatness of the image contained in each area; and when judged a highly flat area, a luminance value of the light source corresponding to the applicable area is set higher than the luminance value corresponding to the applicable area when the flatness is low so that the area is not judged a flat area.

In the image display device of this invention, the light source luminance decision unit may further contain a flatness calculator circuit for calculating the flatness of the image contained in each of the divided areas.

In the image display device of this invention, the flatness calculator circuit may calculate the flatness by utilizing the maximum color component of the pixel value among the plurality of pixels contained in the input image.

In the image display device of this invention, the flatness calculator circuit calculates the flatness of each color component for each pixel contained in the input image and identifies high flatness areas among all color components as flat areas.

In the image display device of this invention, the flatness calculator circuit may calculate the number of pixels contained in the pixel value range defined by a first pixel value and a second pixel value added to a constant number of the first pixel value in a histogram of the input pixel value; and judge an area as a high flatness area when the number of pixels within a pixel value range exceeds the pixel count threshold when the first pixel value is sequentially changed.

In the image display device of this invention, the flatness calculator circuit may output a multi-value signal as the flatness signal and may correct the light source luminance at multiple levels according to the applicable flatness signal.

The image display device of this invention may further contain a viewer direction sensing unit to sense the direction where the viewer is located, and set the luminance of the light source to a high value when there is no viewer in the sideways direction.

In the image display device of this invention the image display unit may further consist of a liquid crystal panel.

The image display device of this invention, contains an image display unit with a structure including a plurality of transmittance control elements mounted on a two-dimensional plane and capable of changing the light transmittance according to the pixel value of the input image, a light source unit containing a plurality of light sources capable of independently controlling the light emission intensity in each area of a screen divided into a plurality of areas and installed so that the light emitted by the plurality of light sources becomes transmitted light for the image display unit, a light source luminance decision unit for setting the light emission luminance value of each of the light sources making up the light source unit according to the input image, a light source luminance control unit to control the luminance of light emitted from each light source making up the light source unit according to the light emission luminance value of each light source set by the light source luminance decision unit, and an image correction unit to correct the pixel values of the image input to the image display unit according to the light emission luminance value of each light source set by the light source luminance decision unit; and further containing a viewer direction sensing unit to sense the direction where the viewer is located, and a feature of the image display device is control of the luminance of the light source based on the output from the viewer direction sensing unit.

An image display device of this invention, whereby the light source may be controlled at a higher luminance when the viewer direction sensing unit detects a person to the side of the display panel, rather than when the sensing unit only detects a person to the front of the panel.

An image display device of this invention, such that the light source may be controlled at a lower luminance when the viewer direction sensing unit only detects a person to the front of the display panel. The image display device of this invention may further consist of a liquid crystal panel.

A light source luminance decision circuit of this invention for deciding the light emission luminance value of each light source in the light source unit according to the input image, and utilized in an image display device containing an image display unit with a structure including a plurality of transmittance control elements mounted on a two-dimensional plane and capable of changing the light transmittance according to the pixel value of the input image; a light source unit containing a plurality of light sources capable of independently controlling the light emission intensity in each area of a screen divided into a plurality of areas and installed so that the light emitted by the plurality of light sources becomes transmitted light for the image display unit, a light source luminance control unit to control the luminance of light emitted from each light source in the light source unit according to the light emission luminance value of each light source, and an image correction unit to correct the pixel values of the image input to the image display unit according to the light emission luminance value of each light source; and which contains a light adjust value calculator circuit to find the maximum value of all pixels contained in each area in an input image per each area and decide the pre-correction light adjust value based on that maximum value; a flatness calculator circuit to calculate the flatness of each area utilizing the pixel value of the input image; and a light adjust value correction circuit to correct the pre-correction light adjust value based on the flatness from the flatness calculator circuit and to set the light adjust value for each area; and then output that decided light adjust value as the light emission luminance value.

A light source luminance decision circuit of this invention in which the light adjust correction circuit corrects the pre-correction light adjust value so as to lower the fading rate of the light source when the flatness from the flatness calculator circuit is high.

A light source luminance decision circuit of this invention further containing a maximum value calculator circuit to find the maximum value of the plural color components in each pixel of the input image and output that maximum value as the value of each pixel.

A light source luminance decision circuit of this invention in which the flatness calculator circuit calculates the flatness in each color component and decides the flatness of the image when the flatness in all color components is high.

In the light source luminance decision circuit of this invention, the flatness calculator circuit consists of a histogram count circuit for counting the number of pixels in each pixel value, a concentration count decision circuit for deciding whether or not there is a cluster of pixels in ranges with designated pixel values for each pixel value group, and a concentration cluster circuit for deciding whether or not pixels are concentrated in at least one group and deciding the flatness of that area.

In the light source luminance decision circuit of this invention, the light adjust correction circuit consists of a correction value calculator circuit for calculating a correction value to make the fading rate of the corresponding light source approach 1 by adjusting the corresponding pre-correction light adjust value, and a selector for selecting either of a pre-correction light adjust value and correction value based on the flatness calculated by the flatness calculator circuit.

The light source luminance decision circuit of this invention further consists of an input terminal for the sideways view signal, and a decision circuit for sending the output from the flatness calculator circuit unchanged when a person is viewing (the screen) from the side; and clamping the output from the flatness calculator to a low flatness when there is no one is viewing (the screen) from the side.

The LSI of this invention is an LSI containing the light source luminance decision circuit.

The present invention calculates an index (flatness) showing the flatness within each area of the image; and in order to alleviate uneven or irregular sections on flat areas as seen from the side, makes the backlight fading rate approach 1 by setting a high light source luminance in that vicinity; and since uneven sections are hard to recognize as seen from the side, the invention does not correct the light source luminance in the vicinity of areas that are not flat, to maintain the effect that cuts power consumption.

DETAILED DESCRIPTION OF THE PREFERRED EMBODIMENTS

Figure 1:
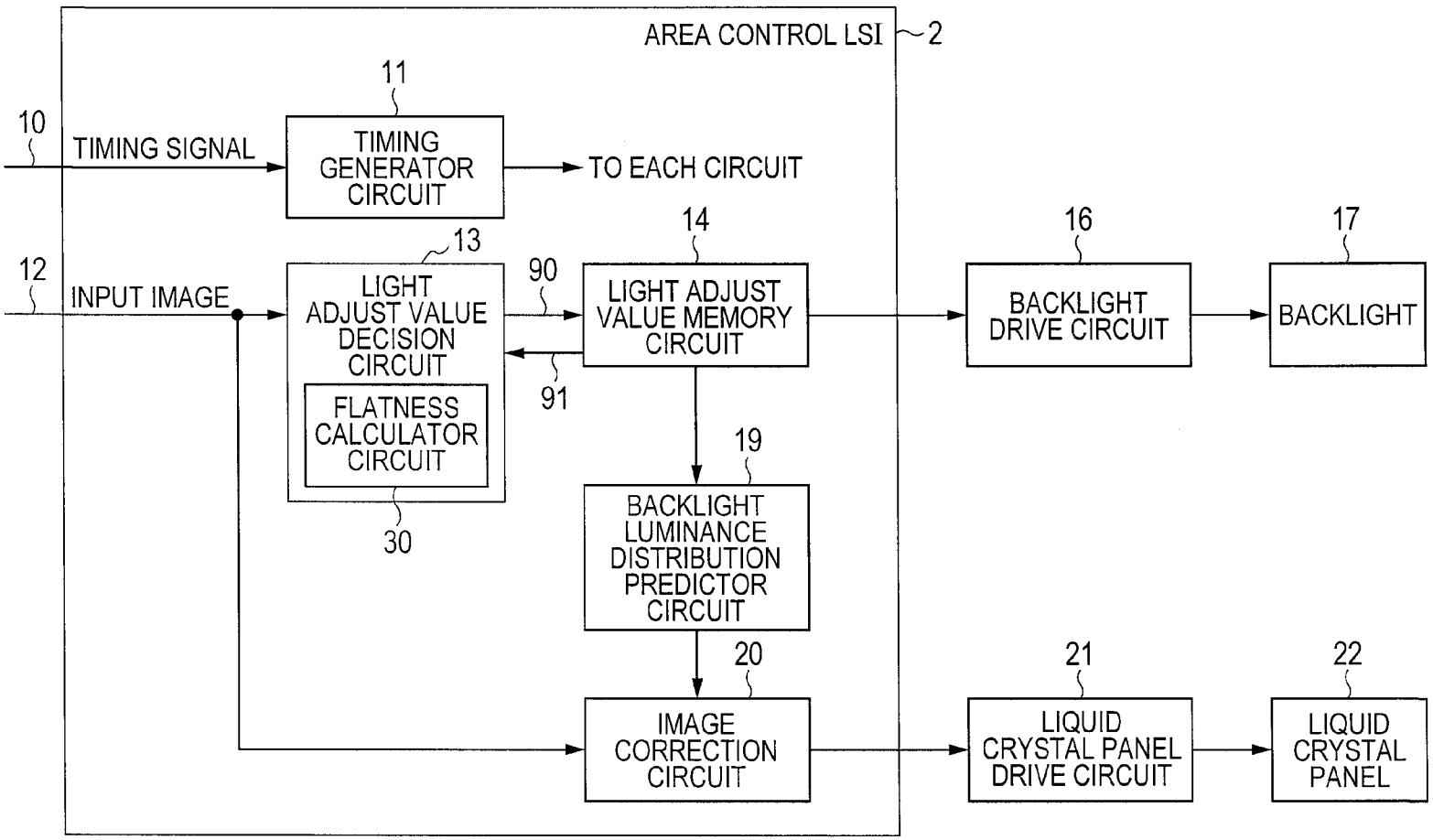
FIG. 1 is a block diagram showing the image display device in a first embodiment of this invention.

The preferred embodiments of the image display device of this invention are described next while referring to the drawings.

First Embodiment

The first embodiment of this invention is described while referring to FIG. 1. A liquid crystal panel 22 in the figure is equivalent to the image display device, and a backlight 17 is equivalent to the light source unit. The backlight 17 contains a plurality of light sources whose light emission intensity can be separately controlled according to each of the plural subdivided screen areas. The backlight 17 is mounted so that the light generated by these light sources becomes light transmitting through the liquid crystal panel 22.

The reference numeral 12 in the figure denotes the input image for the display, reference numeral 10 denotes a signal indicating timing information for the input image 12, and is equivalent to dot clock and synchronous signal. The timing generator circuit 11 generates different types of timing signals such as clocks, addresses, and trigger signals, and supplies these timing signals to other circuits. A description of these timing signals is omitted in order to avoid a complicated drawing but these signals are basically supplied to all the other circuits.

An input image 12 is first of all sent to the light adjust value decision circuit 13. The light adjust value decision circuit 13 analyzes the input image 12 and decides the light emission quantity of each light source in the backlight 17. The light adjust value decision circuit 13 sends the luminance decided for each light source as a light adjust value 90 to the light adjust value memory circuit 14 for storage within the light adjust value memory circuit 14.

The light adjust value memory circuit 14 sends the stored light adjust value to the backlight drive circuit 16 at the timing specified by the timing generator circuit 11. This backlight drive circuit 16 controls the light emission luminance in each area by pulse width modulation of each light source making up the backlight 17 according to the light adjust value that was input.

The backlight luminance distribution predictor circuit 19 predicts the luminance distribution of the backlight 17 when the light of each light source in the backlight is adjusted according to each light adjust value sent from the light adjust value memory circuit 14. The image correction circuit 20 corrects each pixel value so that the brightness from the display luminance for each pixel in the image is approximately the same when all backlight light sources are lit up at their maximum luminance, by utilizing the predicted backlight luminance distribution (Formula 5). This correction makes use of the gamma characteristic when viewing the liquid crystal panel from the front. The image correction circuit 20 sends each corrected pixel value to the liquid crystal panel drive circuit 21 for display on the liquid crystal panel 22. Utilizing this type of structure allows setting the display luminance of the actual image to nearly the same as when the backlight emission luminance was not reduced, even when the emission luminance of each light source making up the backlight was in fact reduced. The power consumption of the backlight can in this case be reduced by an amount equal to the backlight fade amount.

The light adjust value decision circuit contains the flatness calculator circuit 30 described later. In this embodiment, the light adjust value decision circuit 13 and the light adjust value memory circuit 14 are applied to the light source luminance decision unit.

Figure 2:
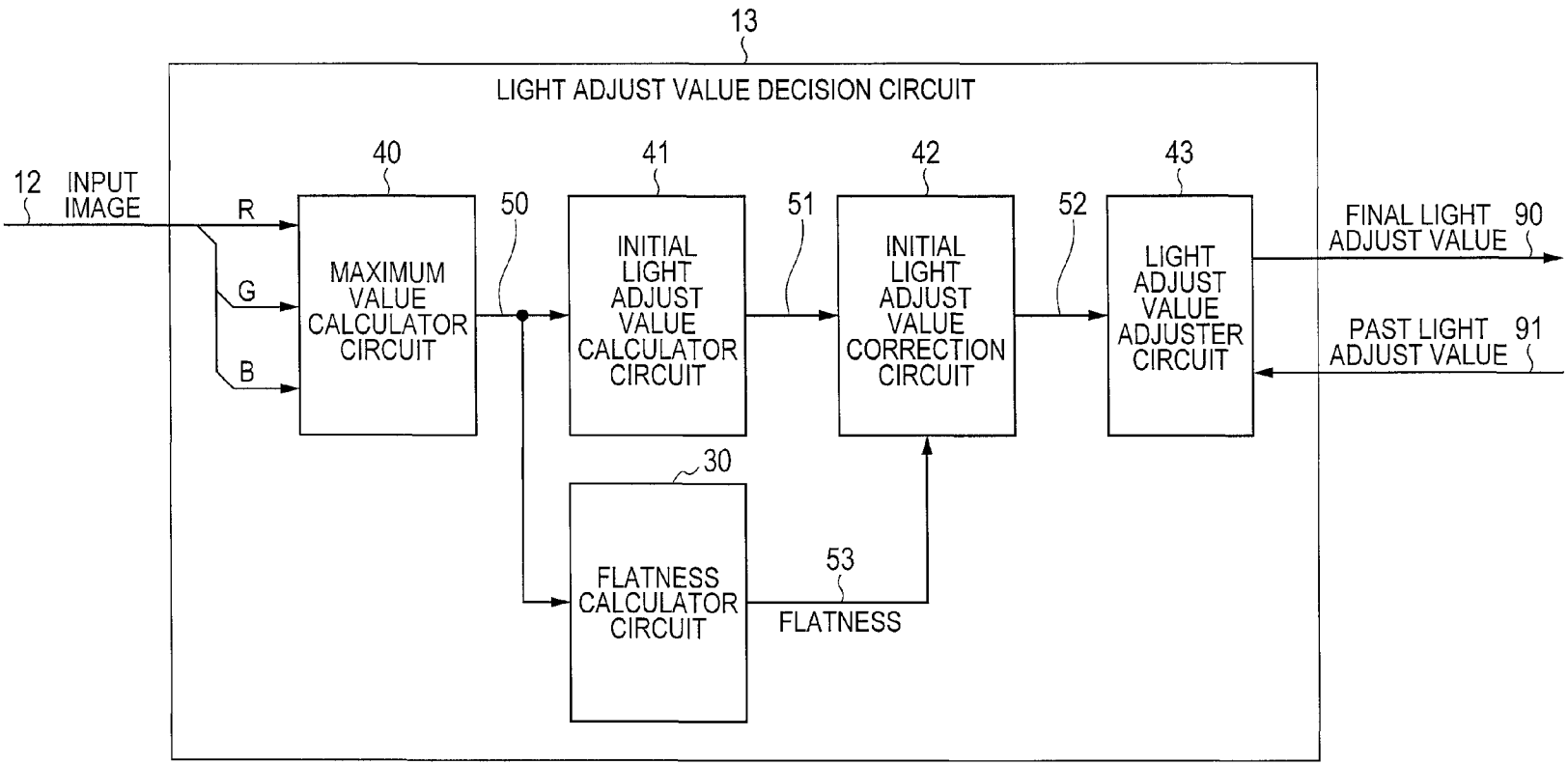
FIG. 2 is a block diagram showing an example of the structure of the light adjust decision circuit.

The structure of the light adjust value decision circuit 13 is described while referring to FIG. 2. In this embodiment, the signal for the input image 12 is made up of the three RGB color components. These three components are first input to the maximum value calculator circuit 40, and the maximum value among the three is output as the maximum component 50. The initial light value adjust value calculator circuit 41 decides the pre-correction initial light adjust value 51 based on the maximum component 50 in each area. There are various methods to find the pre-correction initial light adjust value 51, however for purposes of simplicity the maximum value for the maximum component 50 is here found for all pixels contained in each area, and this maximum value utilized as an index to decide the pre-correction initial light adjust value 51 by referring to the table.

The maximum value calculator circuit 40 inputs the maximum component 50 to the flatness calculator circuit 30. This flatness calculator circuit 30 is a circuit that calculates the flatness 53 for each area by utilizing the maximum component 50 that was input. Here, the flatness is a value shown as a change in pixel value in a spatial direction in that area. The flatness is defined as high in flat area where there is almost no change in the pixel value such as in the solid image; and the flatness is defined as low in an area with a large change in the pixel value such as in a matrix type pattern. Specific methods for calculating flatness are described later on.

The initial light adjust value correction circuit 42 corrects the flatness 53 relative to the pre-correction initial light adjust value 51 that was input. This correction is for the purpose of alleviating the unevenness when the screen is viewed from the side. The initial light adjust value correction circuit 42 is described in detail later on. The light adjust value after correction is sent to the light value adjuster circuit 43 in the next stage as the post-correction initial light adjust value 52.

The light value adjuster circuit 43 for example alleviates the flutter occurring during display of a moving image or differences in luminance steps between areas by applying a filtering process both along the time axis and spatially on the post-correction initial light adjust value 52. The contents of this processing are not directly related to the present invention so a detailed description is omitted here. The light value adjuster circuit 43 outputs the final light adjust value 90 to the light adjust value memory circuit 14.

Figure 3:
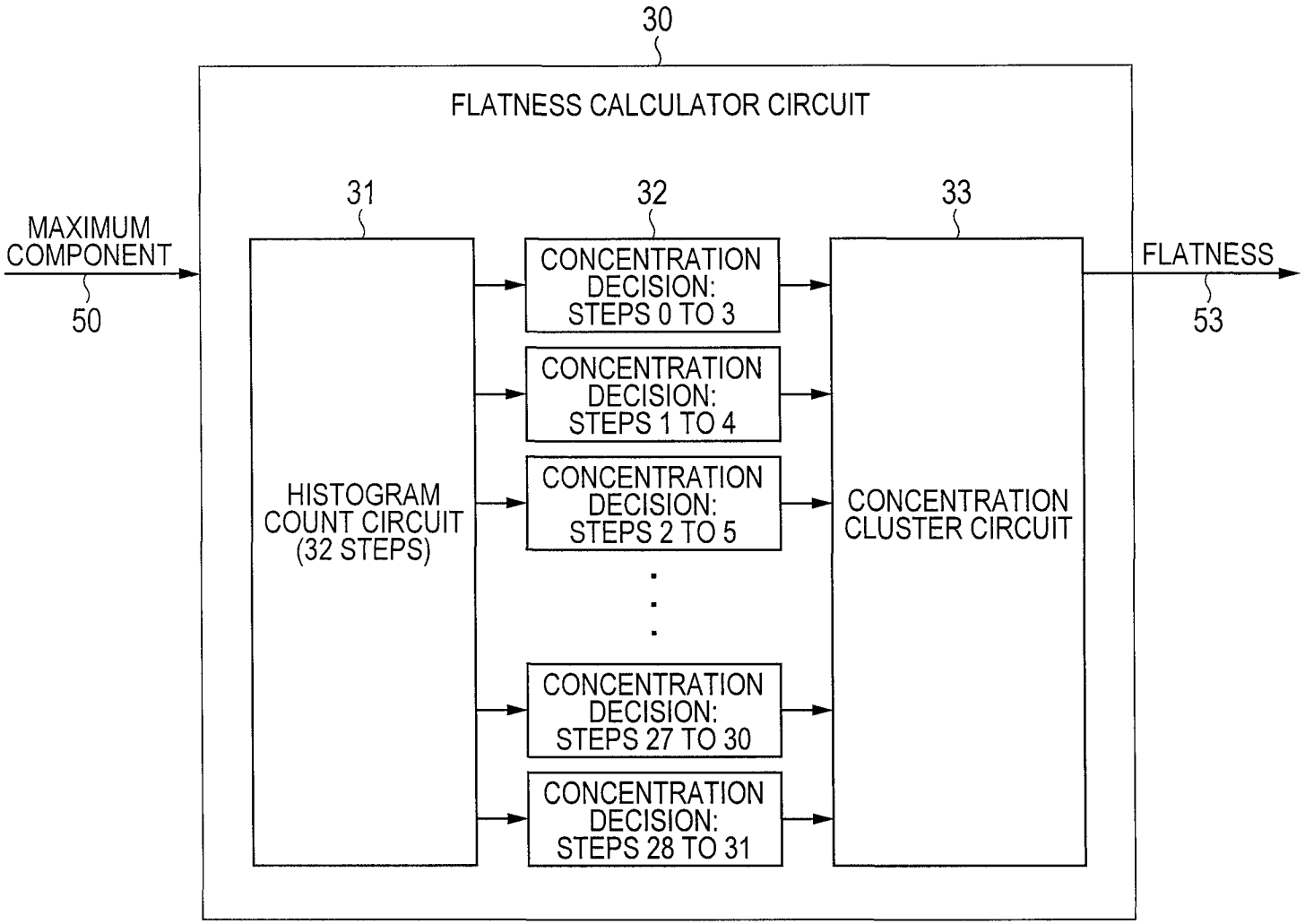
FIG. 3 is a block diagram showing an example of the structure of the flatness calculator circuit.

FIG. 3 shows an example of the structure of the flatness calculator circuit 30.

Figure 4:
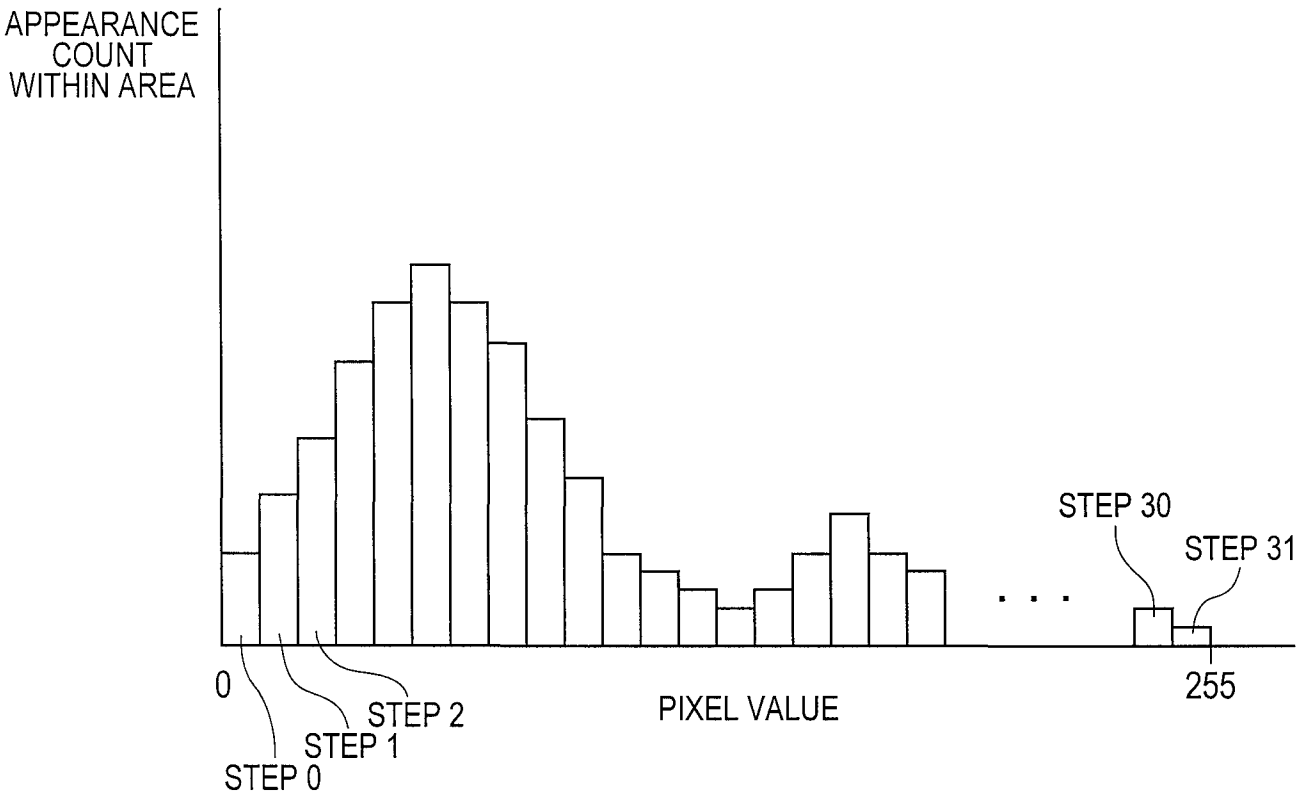
FIG. 4 is a graph showing an example of a histogram of an area with low flatness.

The flatness calculator circuit 30 makes a histogram of pixel values for each area for the maximum component 50 sent from the maximum value calculator circuit 40. FIG. 4 shows an example of one histogram that was made. The example in the figure assumes pixel values in the input image 12 expressed from 0-255 for each component, and that the maximum value 50 for each component is within a range from 0-255. These values from 0-255 are sub-grouped into 32 steps to prevent mutual overlapping. In step 0, the maximum value 50 is from 0 to 7; in step 1 the maximum value 50 is from 8 to 15 and so on so that one step is summarized into 8 segments and there are 32 steps in total.

The 32 steps described here are only an example and an optional number of two or more steps may be used. Moreover, the width of the steps in this example was equal but the width of all steps need not be equal.

A histogram count circuit 31 counts the number of input pixels in each step for each area. FIG. 4 shows an example of a histogram in image form. In this graph the horizontal axis is the pixel value, and the vertical axis is the number of pixels in each step. In the example in FIG. 4, the pixels are spread across the range from step 0 to step 31. The applicable area is in other words made up of various luminance points. The flatness in this area can be called low.

Figure 5:
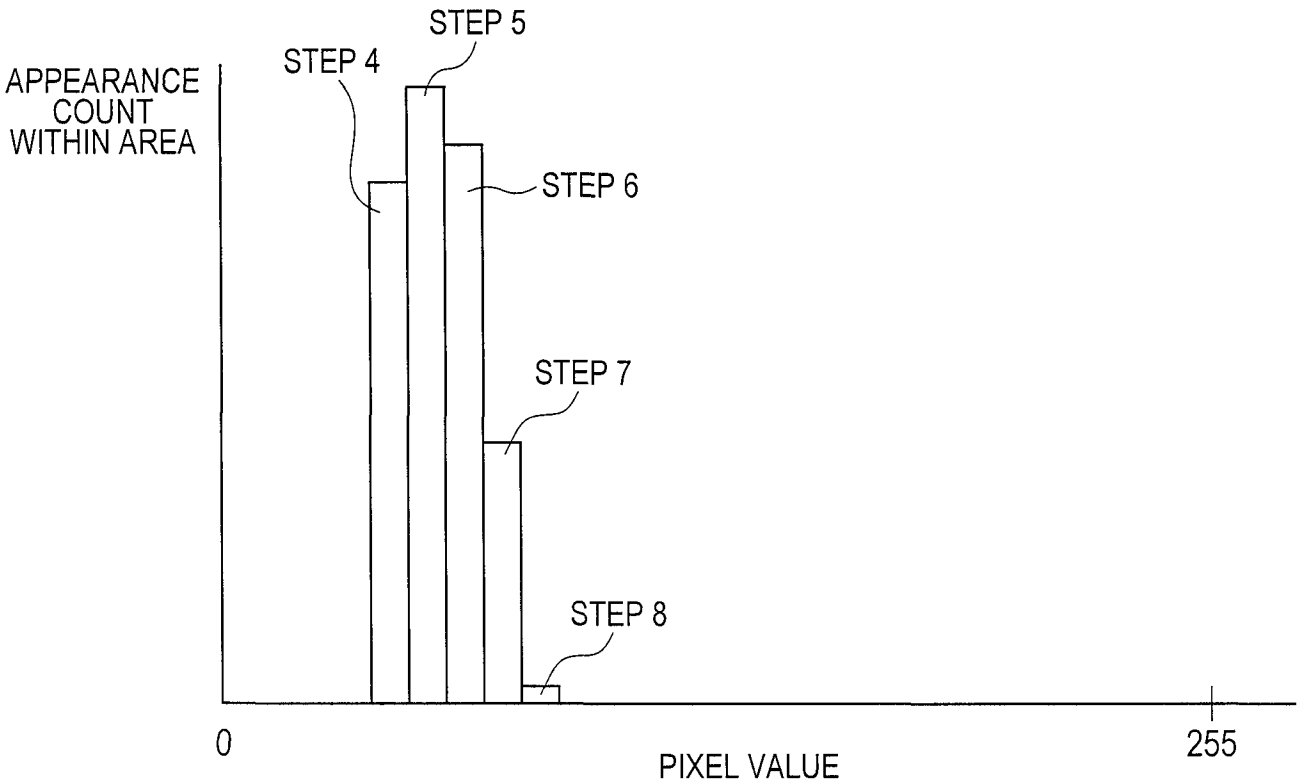
FIG. 5 is a graph showing an example of a histogram of an area with high flatness.

FIG. 5 shows an example of a histogram for another area. Most of the pixels in this example are concentrated in a range from step 4 to step 7 and the change in luminance within the area is therefore small so the flatness in this area can be called high. The flatness of the area in this embodiment is calculated using the same concept. The 32 steps of the histogram are here arranged into four consecutive groups, and the number of pixels contained in groups in each area, and the proportion for the total number of pixels within that area are calculated. The closer that value is to 1, the greater will be the concentration of pixels in that area within that group luminance range. This concentration is expressed by (Formula 6).

$$\text{Concentration} = \text{number of pixels contained in that group} / \text{total number of pixels within the area} \quad \text{(Formula 6)}$$

The concentration count decision circuit 32 calculates the concentration of each group based on Formula 6. When this value exceeds a predefined threshold, the concentration count decision circuit 32 decides the pixels in that area are concentrated within the applicable group.

Each group in this example consisted of four consecutive steps, and there are 29 groups defined by shifting each single start step number. A concentration count decision circuit 32 is prepared for each of these groups as shown in FIG. 3. The concentration decision units 32 send their respective outputs to the concentration cluster circuit 33.

If there is a concentration in even just one among the groups output from the twenty-nine concentration decision units 32 then the concentration cluster circuit 33 decides that area is flat, and outputs a flatness signal 53 as a value signifying that area is flat. In this embodiment, the flatness signal 53 is a 1 bit signal and "H" (flatness: high) indicates that area is flat; and "L" (flatness: low) signifies that area is not flat.

The concentration cluster circuit 33 here checks all of the 29 concentration decision units 32 outputs but need not check all these outputs. The concentration cluster circuit 33 may for example, for simplicity ignore the lower nine concentration decision units 32 outputs and decide from the outputs of only the upper twenty concentration decision units 32 whether or not the area is flat or not.

Figure 6:
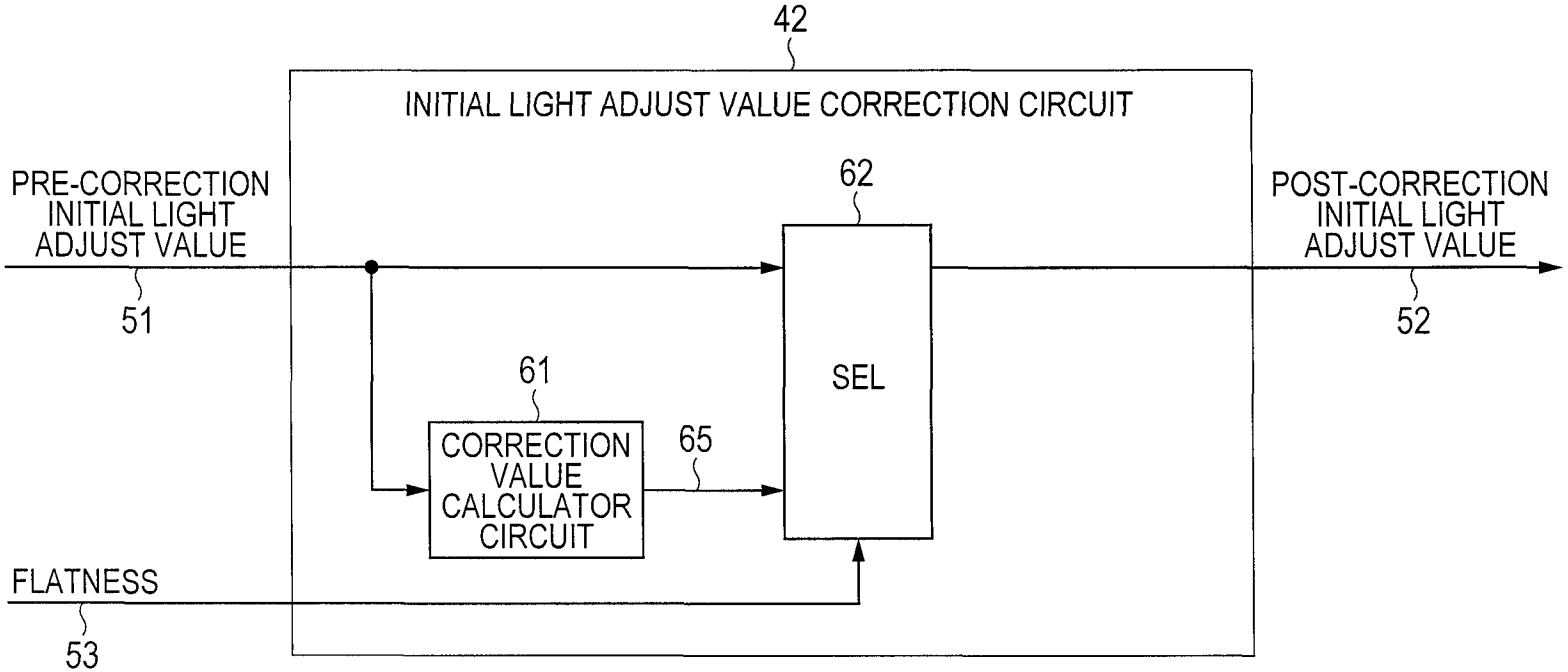
FIG. 6 is a block diagram showing an example of the structure of the initial light adjust value correction circuit.

The calculated flatness signal 53 is in this way sent to the initial light adjust value correction circuit 42. FIG. 6 shows an example of the initial light adjust value correction circuit 42 structure. The correction value calculator circuit 61 in this figure is a circuit for calculating a correction value 65 for adjusting the pre-correction initial light adjust value 51 to set the fading rate of the corresponding light source near 1. An example for calculating this correction value 65 is shown below in (1) and (2). However, these are merely examples and the calculation is not limited to this method. In these examples, the pre-correction initial light adjust value 51 is in a range from 0-255, and 0 indicates a fully extinguished light source, and 255 indicates a light source that is on at a luminance of 100%.

(1) Setting the Fading Rate to a Multiple of the Constant

The fading rate of each light source is calculated by subtracting the pre-correction initial light adjust value from the maximum light adjust value of 255. The light source fade amount can then be reduced by multiplying the fading rate by the correction coefficient $\alpha$. Expressing the correction value 65 by using this method yields the following formula. Here, the correction coefficient $\alpha$ is a constant in a range from 0-1.

$$\text{Correction value} = 255 - (255 - \text{pre-correction initial light adjust value}) \times \text{correction coefficient } \alpha \quad \text{(Formula 7)}$$

(2) Setting a Fading Rate Upper Limit

Setting an upper limit on the fading rate of each light source is equivalent to setting a lower limit on the light adjust value. The following formula is therefore used to establish an upper limit on the fading rate of each light source. In this formula, max (a, b) are functions for returning the larger figure among either a or b; and the lower limit light adjust value $\beta$ is a constant between 0-255.

$$\text{Correction value} = \max(\text{pre-correction initial light adjust value, lower limit light adjust value } \beta \quad \text{(Formula 8)}$$

In both (1) and (2), the correction value 65 is a value equal to or larger than the pre-correction initial light adjust value 51. In other words, using the correction value 65 allows setting the corresponding light source to the same brightness or greater than the pre-correction initial light adjust value 51.

The selector 62 within the initial light adjust value correction circuit 42 selects either the pre-correction initial light adjust value 51 or the correction value 65 according to the flatness signal 53 in each area, and outputs this selection as the post-correction initial light adjust value 52. Namely, when reporting by way of the flatness signal 53 that the applicable area is flat, the selector 62 outputs the correction value 65 and in all other cases outputs the pre-correction initial light adjust value 51 as the post-correction initial light adjust value 52. The fading rate of just the light source corresponding to that flat area can therefore be lowered, and the strange impression of the screen as viewed from the side can be alleviated in areas that tend to give an strange visual impression. This fading rate change process does not apply to images not containing a flat area so there is no loss in the effect that lowers power consumption.

In this embodiment, the range in FIG. 1 enclosed by a frame border 2 is assumed as the area where the single LSI used as the area control LSI is mounted. However the area where the LSI is mounted is not restricted to this area. The liquid crystal panel drive circuit 21 for example can be placed within this LSI. The area enclosed by the frame border 2 may also be utilized by a plurality of LSI.

Second Embodiment

In the first embodiment, a binary H, L signal was employed as the flatness signal 53. More detailed control can however be achieved by employing a multi-value signal. An embodiment employing multi-value signals is described next. The concentration decision unit 32 in FIG. 3 utilized 1 as a threshold value but three other different threshold values are prepared, and by setting the output from concentration decision unit 32 to show which threshold the concentration in each area has exceeded, the concentration decision unit 32 can provide 4 types of outputs. Here, the three threshold values are threshold A, threshold B, and threshold C in order starting from the smallest value. Output values from the concentration decision unit 32 are defined such that: a concentration smaller than threshold A is 0, a concentration larger than threshold A and also smaller than threshold B is 1, a concentration larger than threshold B and also smaller than threshold C is 2, and a concentration larger than threshold C is 3.

The concentration decision unit 32 sends the concentration expressed by integers in a range from 0 to 3 as a two-bit signal to the concentration cluster circuit 33. There are several possible processing methods usable by the concentration decision unit 32 but in the example used here, the largest value among the concentration decision unit 32 output values for each group is output as the flatness signal 53. The concentration decision unit 32 sends this flatness signal 53 to the initial light adjust value correction circuit 42.

Figure 7:
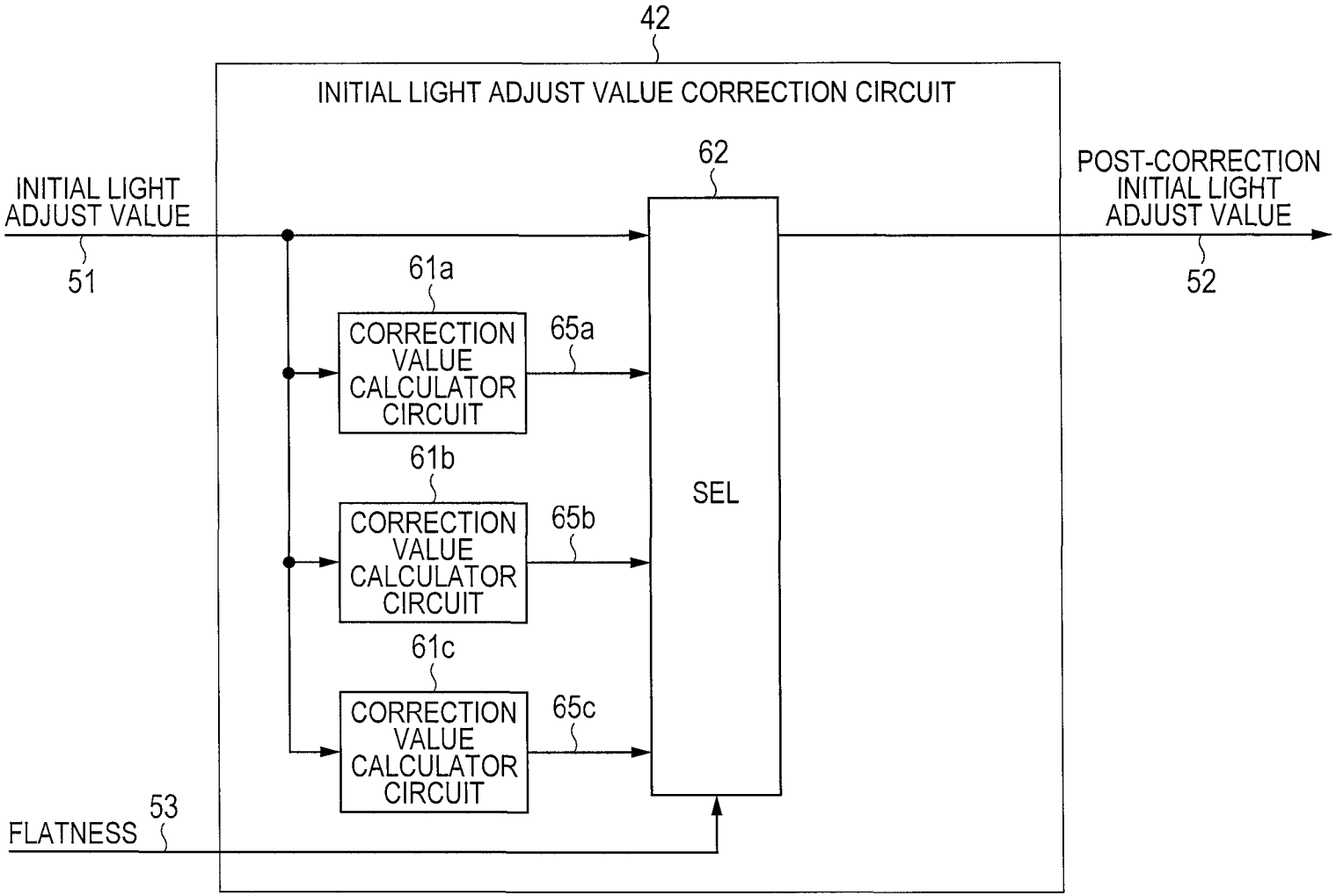
FIG. 7 is a block diagram showing the initial light adjust value correction circuit in a second embodiment of this invention.

FIG. 7 shows the structure of the initial light adjust value correction circuit 42 in this embodiment. The correction value calculator circuits 61*a*, 61*b*, 61*c* in this figure possess the same structure as the correction value calculator circuit 61 in the first embodiment however different correction coefficients $\alpha$ or lower limit light adjust value $\beta$ are utilized in each circuit. Consequently, the outputs 65*a*, 65*b*, 65*c* are also different values. These output signals are connected to the selector 62, and one among the four inputs to the selector 62 is output as the post-correction initial light adjust value 52 according to the value of the two-bit flatness signal.

By making a more detailed decision on the flatness in this way, finer control can be achieved so the power consumption reduction effect can be enhanced even further.

Third Embodiment

If only the color tone of the pixels in the area were changed in the structures of the first and second embodiments then that area might be mistakenly recognized as a flat area. In an image for example where the pixels include the three RGB components, if the maximum values of these three components are within a fixed range within the area then that area will be recognized as a flat area even if there is a large fluctuation width among the RGB components.

Figure 8:
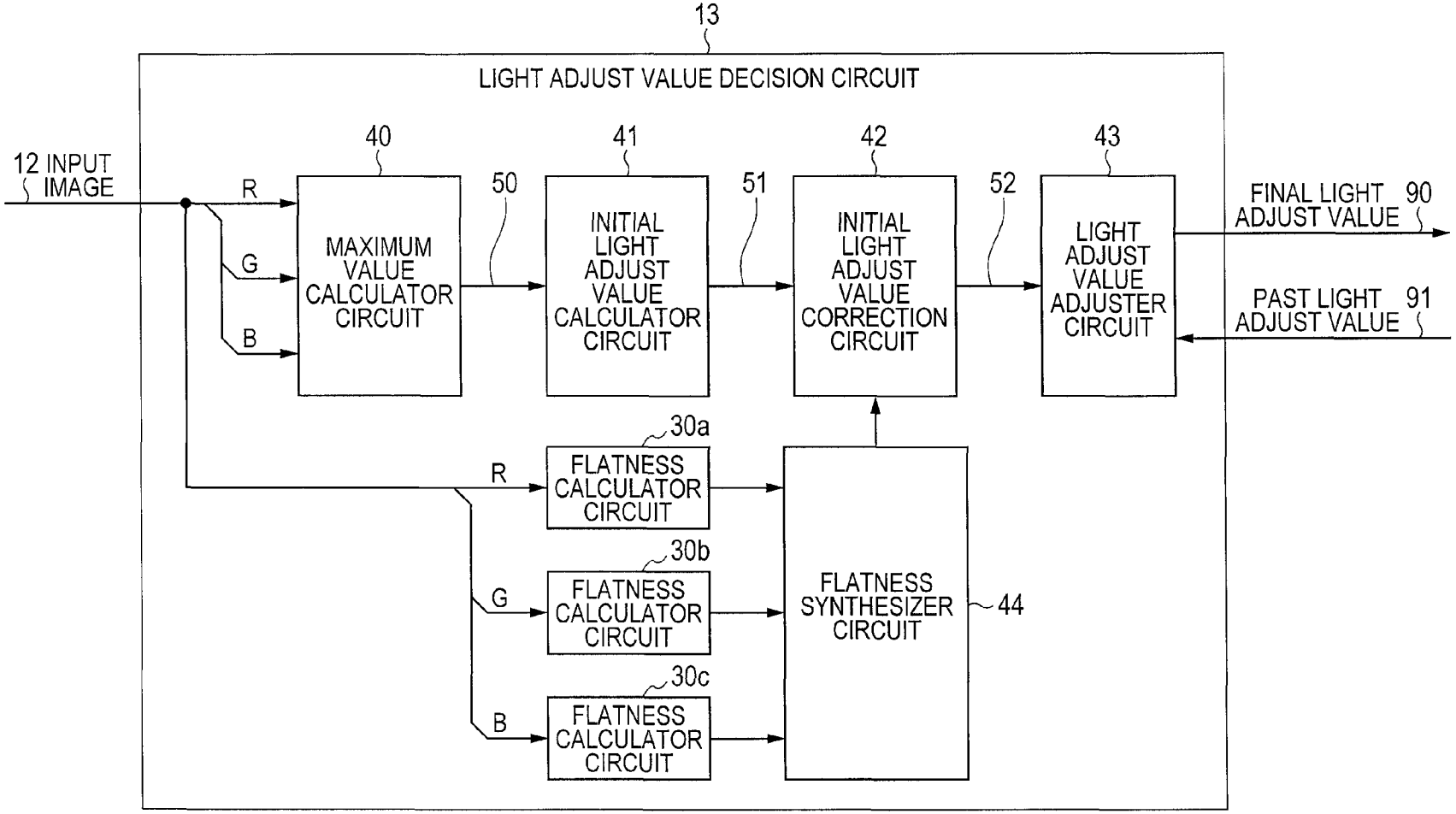
FIG. 8 is a block diagram showing the light adjust value decision circuit in a third embodiment of this invention.

One method to prevent this faulty recognition is to calculate the flatness in each RGB component and utilize those values to calculate the flatness of each area. This method is illustrated in FIG. 8. In this structure, the flatness calculator circuits 30*a*, 30*b*, 30*c* are provided in a format corresponding to each of the RGB components. These circuit structures are the same as the flatness calculator circuit 30 in the first embodiment. A flatness synthesizer circuit 44 calculates the total flatness of the area from the flatness of each component sent from these three flatness calculator circuits. If the color component flatness of each component is expressed by the two values H (flatness: High) and L (flatness: Low), then the flatness of the three components are all only H so the image is decided to be a flat area. Applying this type of processing prevents mistakenly deciding an area is flat even when only the color tone has changed.

Fourth Embodiment

The first through third embodiments described methods for alleviating the strange viewing impression without utilizing information on from which direction the viewer was observing the screen. If information on from which direction the viewer was observing the screen could be obtained then a more powerful effect could be rendered. This embodiment is described while referring to FIG. 9 through FIG. 11.

Figure 10:
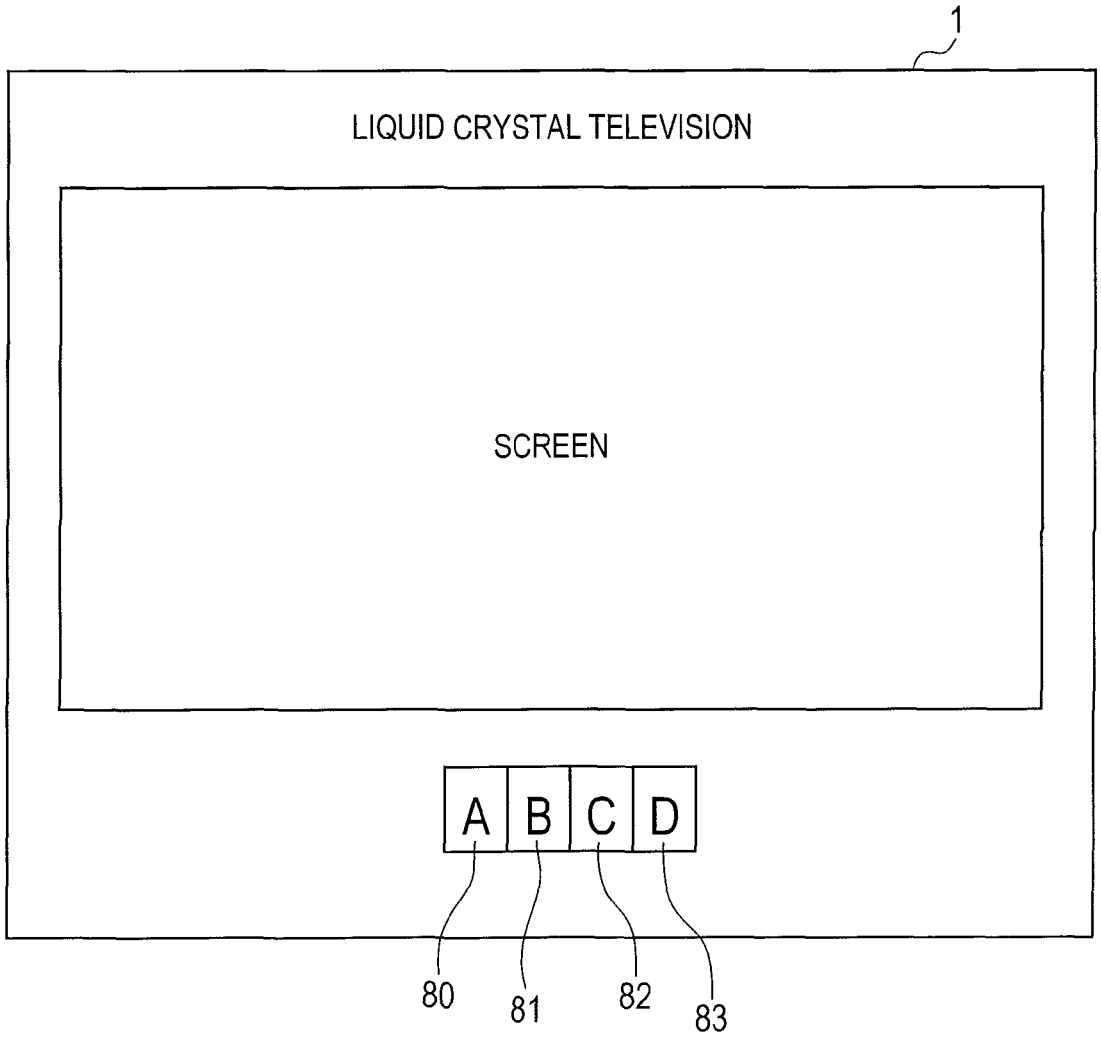
FIG. 10 is a drawing of the people sensor installed in a television set as seen from the front.

In the present embodiment, people sensors 80-83 for detecting the position of the viewer are installed on the front surface of a liquid crystal television 1 as shown in FIG. 10. These sensors need not always be installed on the front surface of the television 1 if still capable of detecting the viewer position and may also be installed on the side of the television 1 or the exterior of the television 1 cabinet. There are various methods to implement the people sensors including detection of heat sources by infrared sensor and use of TV cameras, etc. A total of four people sensors were utilized in the description here but if a method can be contrived for dynamically changing the directivity then a single sensor may be utilized.

Figure 11:
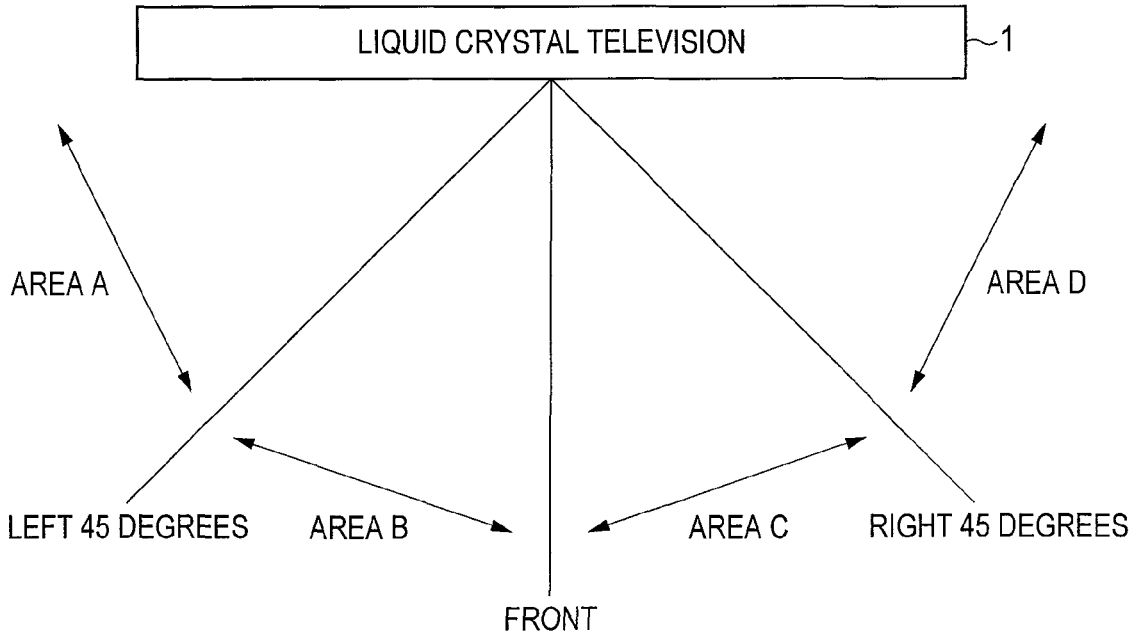
FIG. 11 is a drawing showing the detection range of the people sensor.

The four people sensors 80-83 in this embodiment correspond to the ranges A-D in FIG. 11. FIG. 11 shows the liquid crystal television as seen from above. The viewing directions are grouped into four areas centering on the front side viewing. Each sensor detects one range in a one-to-one relation such that sensor 80 detects the viewer if within the range A, and the people sensor 81 detects a viewer if within the range B, and so on. The number of ranges utilized here is four but another number may of course be utilized.

Figure 9:
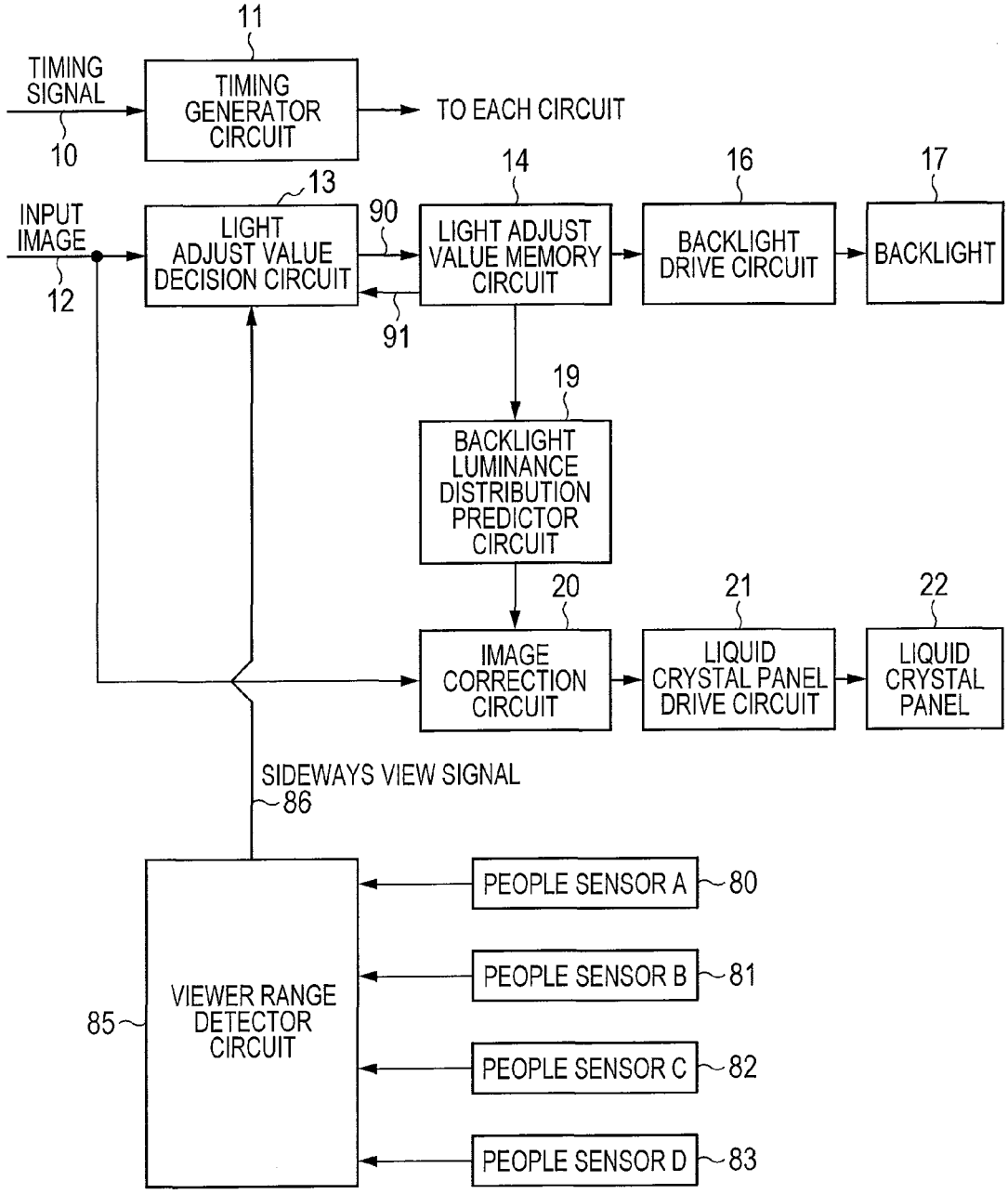
FIG. 9 is a chart showing the image display device in a fourth embodiment of this invention.

The outputs from the people sensors 80-83 are input to the viewer range detector circuit 85 in FIG. 9. When the viewer range detector circuit 85 decides that a person is in range A or range D per the people sensor 80 or 83, the viewer range detector circuit 85 utilizes the sideways view signal 86 to report the information that a person is viewing the screen from the side to the light adjust value decision circuit 13. However when the viewer range detector circuit 85 decides there is no person in the sideways direction in the range A and range B, it notifies the light adjust value decision circuit 13 via the sideways view signal 86 with the information that no person is viewing the screen from the side.

Figure 12:
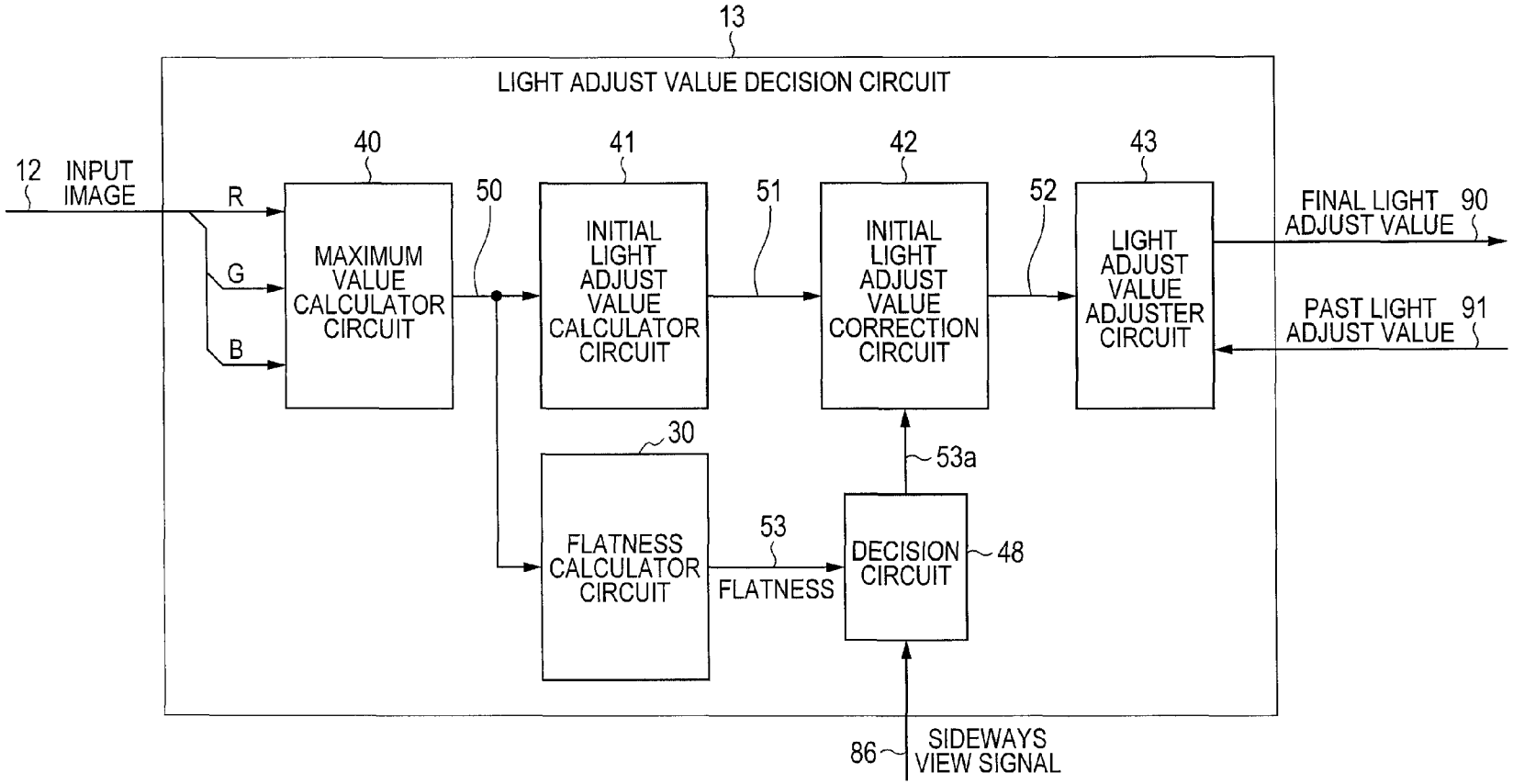
FIG. 12 is a block diagram showing the light adjust value decision circuit in the fourth embodiment of this invention.

FIG. 12 shows the light adjust value decision circuit 13 structure. When notified with information via the sideways viewing signal 86 that a person is viewing the screen from the side, the light adjust value decision circuit 13 sends the output 53 of flatness calculator circuit 30 unchanged as the output 53*a* of decision circuit 48. However, when notified with information that there is no person viewing the screen from the side, then the light adjust value decision circuit 13 clamps the signal 53*a* at L (flatness: low). The initial light adjust value correction circuit 42 does not correct the initial light adjust value and the uncorrected signal 51 value is sent unchanged as the signal 52.

Utilizing this structure allows correcting the initial light adjust value according to the position of the viewer. In other words, when the viewer is only at the front of the screen, then no enhancement of light source luminance is made for alleviating the strange impression caused by viewing from the side, so that electrical power consumption is further reduced.

Fifth Embodiment

Figure 13:
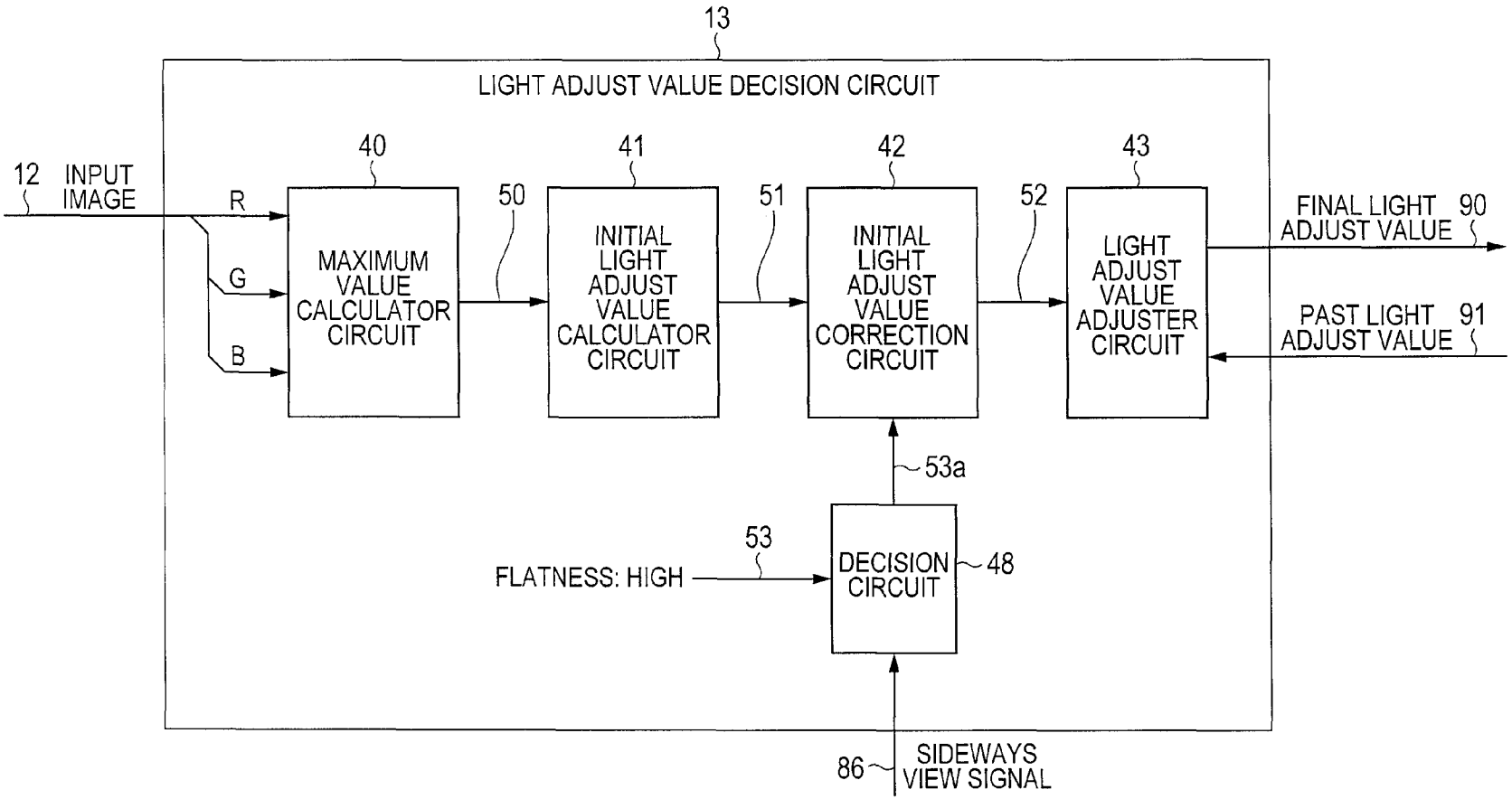
FIG. 13 is a block diagram showing the light adjust value decision circuit in a fifth embodiment of this invention.

A simplified circuit configuration can be achieved by omitting the flatness decision processing from the fourth embodiment. This circuit configuration is described while referring to FIG. 13. In this example, flatness signal 53 input to the decision circuit 48 is clamped at H (flatness: High). The signal 53*a* is therefore clamped at H (flatness: High) when the decision circuit 48 is notified by the sideways viewing signal 86 that a person is viewing the screen from the side. The initial light adjust value correction circuit 42 is therefore capable of correcting the initial light adjust values for all light sources regardless of the flatness of the actual image.

However the signal 53*a* is clamped at L (flatness: low) when notified by the sideways viewing signal 86 that there is no person viewing the screen from the side. The initial light adjust value correction circuit 42 can therefore constantly perform correction processing regardless of the flatness of the actual image.

Utilizing this structure allows correcting the initial light adjust value according to the position of the viewer. Namely, when the viewer is only at the front of the screen, no enhancement of light source luminance is made for alleviating the strange impression caused by viewing from the side, so that electrical power consumption is reduced even further.

In the fourth and fifth embodiments, a change in light source luminance may occur due to movement of the viewer even when a still image is being displayed. The viewer might experience a strange impression when this change in light source luminance occurs suddenly. In such cases, adjusting the internal filter within the light value adjuster circuit 43 along the time axis will prove effective.

The present invention can therefore be utilized on image display systems that display image data by utilizing a backlight such as liquid crystal display devices, and is also capable of reducing the electrical power consumption.

What is claimed is:

1. An image display device comprising:

an image display unit with a structure including a plurality of light transmittance control elements mounted on a two-dimensional plane and capable of changing the light transmittance according to pixel values of the input image;

a light source unit containing a plurality of light sources capable of independently controlling a light emission intensity corresponding to each area of a screen divided into a plurality of areas and installed so that light emitted by the plurality of light sources becomes transmitted light for the image display unit;

a light source luminance decision unit to set a light emission luminance value of each light source in the light source unit according to the input image;

a light source luminance control unit to control light emission luminance from each light source in the light source unit according to the light emission luminance value of each light source set by the light source luminance decision unit; and an image correction unit to correct the pixel values of the image input to the image display unit according to the light emission luminance value of each light source set by the light source luminance decision unit, wherein, when setting the light emission luminance value, the light source luminance decision unit divides the input image into a plurality of areas corresponding to the plurality of light sources, and calculates a flatness as an indicator expressing the flatness of the image contained in each area; and when an applicable area flatness is high and the area is judged a flat area, the light emission luminance value of the light source corresponding to the applicable area is set higher than when the applicable area flatness is low and the area is not judged a flat area, wherein the applicable area flatness is high when the pixel values within a certain luminance range are concentrated in the applicable area, and otherwise, the applicable area flatness is low.

2. The image display device according to claim 1, wherein the light source luminance decision unit comprises a flatness calculator circuit to calculate the flatness of the image contained in each of the plurality of areas.

3. The image display device according to claim 2, wherein the flatness calculator circuit calculates the flatness by utilizing the pixel value of a maximum color component among a plurality of color components for each pixel contained in the input image.

4. The image display device according to claim 2, wherein the flatness calculator circuit calculates the flatness of each color component for each pixel contained in the input image and identifies areas with high flatness among all the color components as flat areas.

5. The image display device according to claim 2, wherein the flatness calculator circuit counts pixels contained in a pixel value range defined by a first pixel value, and a second pixel value as a constant number added to the first pixel value in a histogram of input pixel values; and judges an area as a high flatness area when the number of pixels within the pixel value range exceeds the pixel count threshold when the first pixel value is sequentially changed.

6. The image display device according to claim 2, wherein the flatness calculator circuit outputs a multi-value signal as the flatness and corrects the light source luminance at multiple levels according to the multi-value signal.

7. The image display device according to claim 1, further comprising a viewer direction sensing unit to sense a direction where the viewer is located, and set the light emission luminance value of the light source to a high value when there is no viewer in the sideways direction.

8. The image display device according to claim 1, wherein the image display unit is a liquid crystal panel.

9. A light source luminance decision circuit to set a light emission luminance value of each light source in a light source unit according to an input image, and utilized in an image display device containing an image display unit with a structure including a plurality of light transmittance control elements mounted on a two-dimensional plane and capable of changing the light transmittance according to pixel values of the input image, the light source unit containing a plurality of light sources capable of independently controlling a light emission intensity in each area of a screen divided into a plurality of areas and installed so that light emitted by the plurality of light sources becomes transmitted light for the image display unit, a light source luminance control unit to control light emission luminance from each light source in the light source unit according to the light emission luminance value of each light source, and an image correction unit to correct the pixel values of the image input to the image display unit according to the light emission luminance value of each light source, the light source luminance decision circuit further comprising:

a light adjust value calculator circuit to find a maximum value of all pixels contained in each area in an input image per each area and decide a pre-correction light adjust value based on that maximum value;

a flatness calculator circuit to calculate a flatness of each area utilizing the pixel values of the input image; wherein the flatness is high when the pixel values within a certain luminance range are concentrated in a corresponding area, and otherwise, the flatness is low; and a light adjust value correction circuit to correct the pre-correction light adjust value based on the flatness from the flatness calculator circuit and to set a light adjust value for each area, wherein the light adjust value that was set is output as the light emission luminance value.

10. The light source luminance decision circuit according to claim 9, wherein the light adjust value correction circuit corrects the pre-correction light adjust value so as to lower a fading rate of a corresponding light source when the flatness from the flatness calculator circuit is high.

11. The light source luminance decision circuit according to claim 9, further comprising a maximum value calculator circuit to find a maximum value of a plural of color components in each pixel of the input image and output that maximum value as the pixel value of each pixel.

12. The light source luminance decision circuit according to claim 9, wherein the flatness calculator circuit calculates the flatness in each color component and decides the flatness of the image when the flatness in all color components is high.

13. The light source luminance decision circuit according to claim 9, wherein the flatness calculator circuit includes:

a histogram count circuit to count the pixels among a plurality of histogram pixel values;

a concentration count decision circuit to decide whether or not there is a cluster of pixels in ranges with designated pixel values for each pixel value group of a plurality of pixel value groups; and a concentration extent cluster circuit to decide whether or not pixels are concentrated in at least one pixel value group and decide the flatness of that area based on a predetermined pixel concentration.

14. The light source luminance decision circuit according to claim 9, wherein the light adjust value correction circuit includes:

a correction value calculator circuit to calculate a correction value to make a fading rate of a corresponding light source approach 1 by adjusting a corresponding pre-correction light adjust value; and a selector to select either the pre-correction light adjust value or a correction value based on the flatness calculated by the flatness calculator circuit.

15. The light source luminance decision circuit according to claim 9, further comprising:

an input terminal for a sideways view signal; and a decision circuit to send the output from the flatness calculator circuit unchanged when a person is viewing the screen from a side; and clamping the output from the flatness calculator circuit to a low flatness when no one is viewing the screen from the side.

16. The light source luminance decision circuit according to claim 9, wherein the light source luminance decision circuit is inside an integrated circuit.

* * * * *